US007841499B2

(12) United States Patent
Ho

(10) Patent No.: US 7,841,499 B2
(45) Date of Patent: Nov. 30, 2010

(54) GAS CAN MOUNTING STRUCTURE FOR GAS-OPERATED NAIL GUN

(75) Inventor: Yu-Chuan Ho, Taichung County (TW)

(73) Assignee: Superior Power Tool Co., Ltd., Taichung County (TW)

( * ) Notice: Subject to any disclaimer, the term of this patent is extended or adjusted under 35 U.S.C. 154(b) by 126 days.

(21) Appl. No.: 12/292,782

(22) Filed: Nov. 26, 2008

(65) Prior Publication Data

US 2010/0127038 A1 May 27, 2010

(51) Int. Cl.
*B25C 1/04* (2006.01)
*B25F 5/02* (2006.01)

(52) U.S. Cl. ..... 227/10; 227/9; 227/130

(58) Field of Classification Search ..... 227/10, 227/9, 156, 130
See application file for complete search history.

(56) References Cited

U.S. PATENT DOCUMENTS 4,349,028 A * 9/1982 Green ..... 606/143
4,403,722 A * 9/1983 Nikolich ..... 227/8
4,483,474 A * 11/1984 Nikolich ..... 227/8
4,705,200 A * 11/1987 Kopf et al. ..... 227/9
5,364,001 A * 11/1994 Bryan ..... 227/175.1
5,636,780 A * 6/1997 Green et al. ..... 227/176.1
6,041,603 A * 3/2000 Phillips ..... 60/632
6,176,412 B1 * 1/2001 Weinger et al. ..... 227/142
6,179,192 B1 * 1/2001 Weinger et al. ..... 227/8
6,786,378 B2 * 9/2004 Wagdy et al. ..... 227/9
7,478,740 B2 * 1/2009 Shea et al. ..... 227/10
7,571,841 B2 * 8/2009 Gibson et al. ..... 227/10
2004/0211809 A1 * 10/2004 Gantner et al. ..... 227/10
2006/0060628 A1 * 3/2006 Larkin et al. ..... 227/10
2006/0102111 A1 * 5/2006 Ohmori et al. ..... 123/46 H
2007/0131731 A1 * 6/2007 Moeller et al. ..... 227/10
2008/0000451 A1 * 1/2008 Shea et al. ..... 123/46 SC
2008/0029566 A1 * 2/2008 Shkolnikov et al. ..... 227/10
2008/0110953 A1 * 5/2008 Gibson et al. ..... 227/10
2009/0090762 A1 * 4/2009 Leimbach et al. ..... 227/130
2009/0206121 A1 * 8/2009 Araiza ..... 227/10
2010/0096429 A1 * 4/2010 Ho ..... 227/130

* cited by examiner

*Primary Examiner*—Brian D Nash
(74) *Attorney, Agent, or Firm*—Bacon & Thomas, PLLC

(57) ABSTRACT

A gas can mounting structure includes a holder frame formed of a part of a gas-operated nail gun and defining an accommodation chamber for accommodating a gas can, a cover pivoted to the holder frame and turnable relative to the holder frame to close/open the accommodation chamber, and a control switch mounted in the holder frame and movable between a first position where a stop block of the button of the control switch is stopped at a stop block at the cover to lock the cover in the close position and a second position where the stop block of the button is released from the stop block of the cover for allowing the cover to be biased from the close position to the open position for easy loading/unloading of a gas can.

4 Claims, 6 Drawing Sheets

GAS CAN MOUNTING STRUCTURE FOR GAS-OPERATED NAIL GUN

BACKGROUND OF THE INVENTION

1. Field of the Invention

The present invention relates to a gas-operated nail gun and more specifically, to a gas can mounting structure for gas-operated nail gun.

2. Description of the Related Art

Referring to FIG. 1, a gas-operated nail gun has a gas can mounting structure 10 for the loading of a gas can. The gas can mounting structure 10 comprises a holder frame 12, an accommodation chamber 122 defined in the holder frame 12 for accommodating a gas can 16, a screw hole 124 formed in the top side of the holder frame 12 in communication between the accommodation chamber 122 and the outside space, and a screw cap 14 for threading into the screw hole 124 to close the accommodation chamber 122.

When replacing the gas can 16, the user must remove the screw cap 14 from the screw hole 124, and then take the gas can 16 out of the accommodation chamber 122. After loading of a new gas can in the accommodation chamber 122, the screw cap 14 is threaded into the screw hole 124 to close the accommodation chamber 122 again.

According to this design, loading or unloading of a gas can takes much time. If the engagement between the screw cap 14 and the screw hole 124 is excessively tight, the user must employ much effort to unfasten the screw cap 14 from the screw hole 124. Further, the threads of the screw cap 14 and the screw hole 124 may wear quickly with use. When the threads are damaged, a new screw cap must be used or, the screw hole 124 must be repaired.

SUMMARY OF THE INVENTION

The present invention has been accomplished under the circumstances in view. It is therefore the main object of the present invention to provide a gas can mounting structure, which facilitates loading/unloading of the gas can. It is another object of the present invention to provide a gas can mounting structure, which is durable in use, lowering the risk of structural damage and saving maintenance cost.

To achieve these and other objects of the present invention, a gas can mounting structure is used in a gas-operated nail gun, comprising a holder frame, a cover, and a control switch. The holder frame comprises an accommodation chamber adapted for accommodating a gas can, an opening disposed in communication with the accommodation chamber and the outside of the holder frame, and an oblique guide groove. The cover is pivoted to the holder frame, and biasable relative to the holder frame between a close position where the cover closes the opening of the holder frame and an open position where the cover is kept away from the opening, the cover comprising a first stop block. The control switch comprises a button. The button comprises a body and a second stop block protruded from the body. The body is received in the oblique guide groove of the holder frame, and movable along the oblique guide groove between a first position where the second stop block is stopped at the first stop block of the cover to hold the cover in the close position and a second position where the second stop block is released from the first stop block for allowing the cover to be biased from the close position to the open position.

When moved the control switch from the first position to the second position, the first stop block of the cover is released from the constrain of the second stop block of the control switch, allowing the cover to be biased from the close position to the open position for loading/unloading of the gas can.

DETAILED DESCRIPTION OF THE INVENTION

Figure 1:
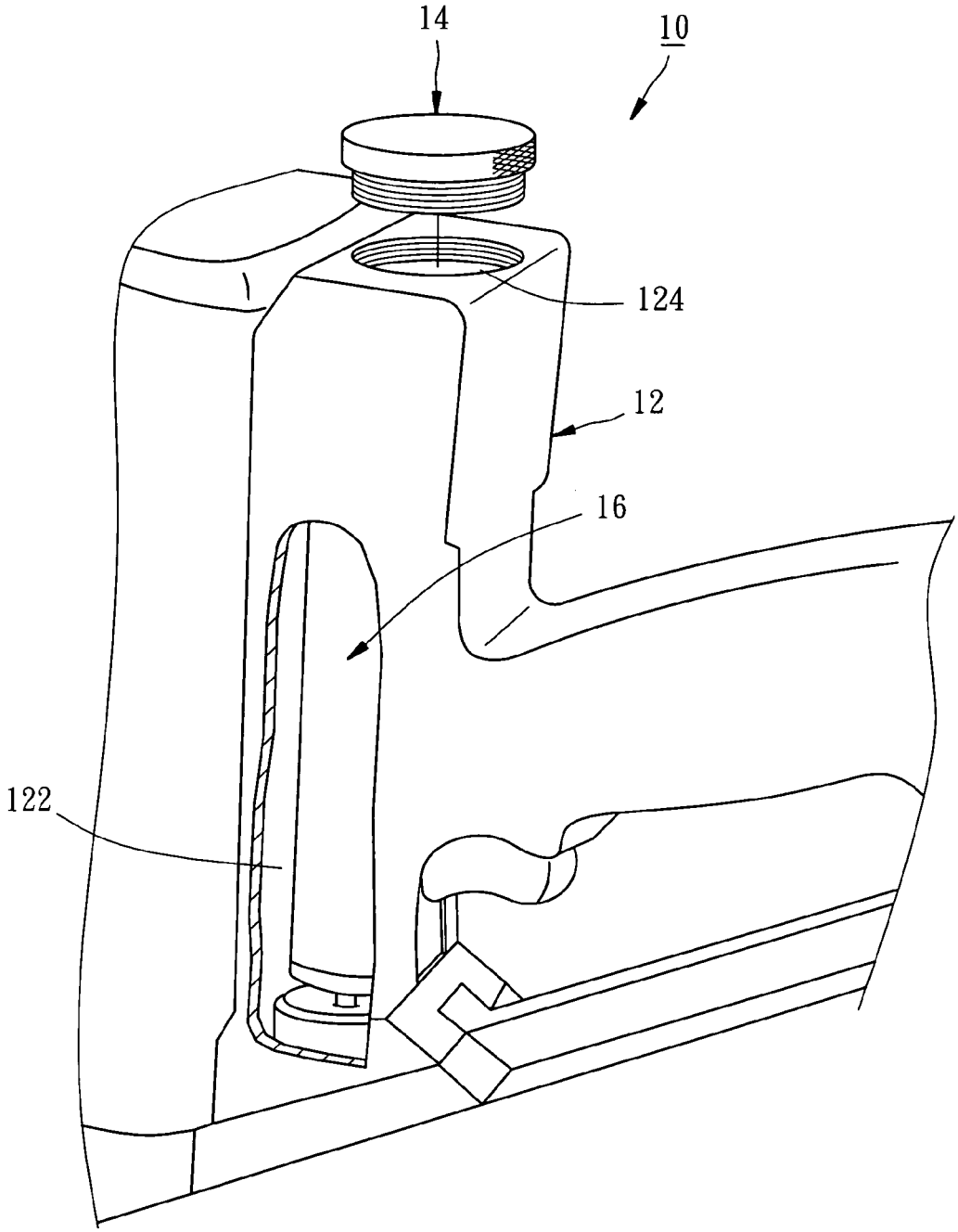
FIG. 1 PRIOR ART
FIG. 1 is a schematic drawing showing a gas can mounting structure of a conventional gas-operated nail gun.
Figure 2:
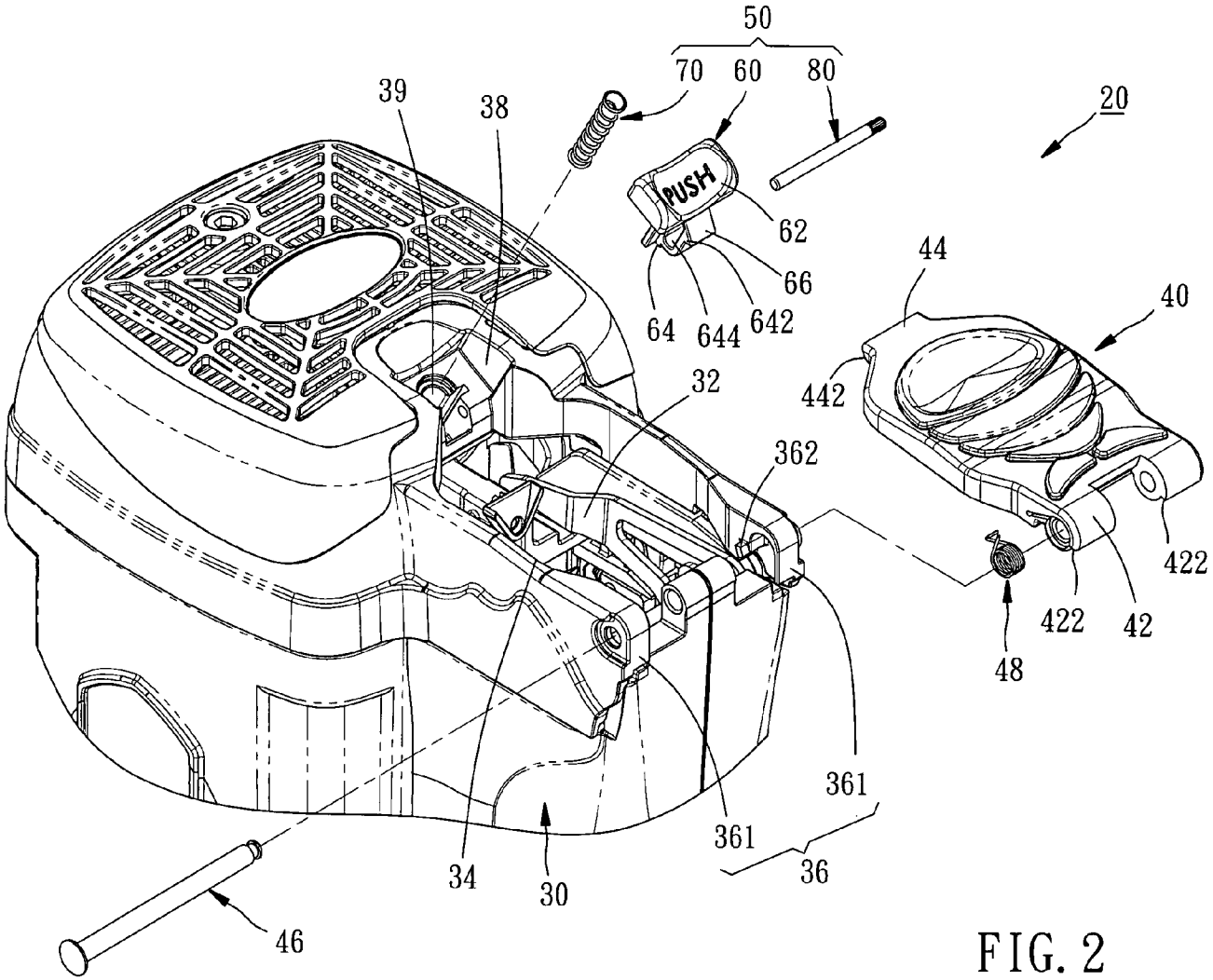
FIG. 2 is an exploded view of a gas can mounting structure for gas-operated nail gun according to the present invention.

Referring to FIG. 2, a gas can mounting structure 20 in accordance with a first embodiment of the present invention is shown comprising a holder frame 30, a cover 40, and a control switch 50.

The holder frame 30 has an accommodation chamber 32 for accommodating a gas can (not shown), an opening 34 disposed in communication with the accommodation chamber 32, a first coupling structure 36 disposed adjacent to the opening 34 at one side, a receiving hole 38 disposed adjacent to the opening 34 at an opposite side, and an oblique guide groove 39 disposed in communication with the receiving hole 38. The first coupling structure 36 comprises a plurality of axle housings 361, and two protruding blocks 362 respectively inwardly protruded from the two axle housings 361 that are disposed at two opposite sides.

Figure 3:
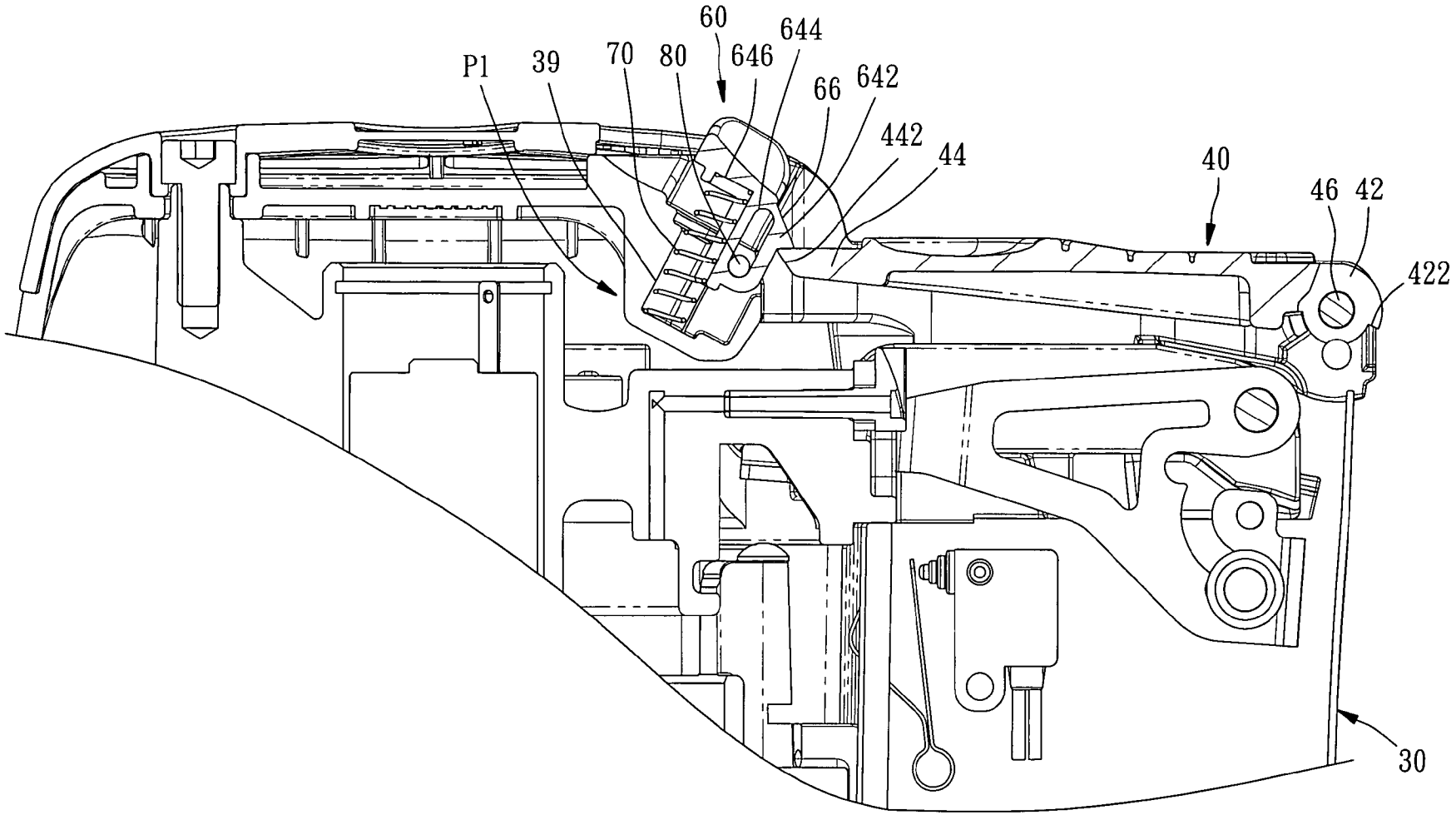
FIG. 3 is a sectional view of the present invention, showing the second stop block of the button stopped at the first stop block of the cover.
Figure 5:
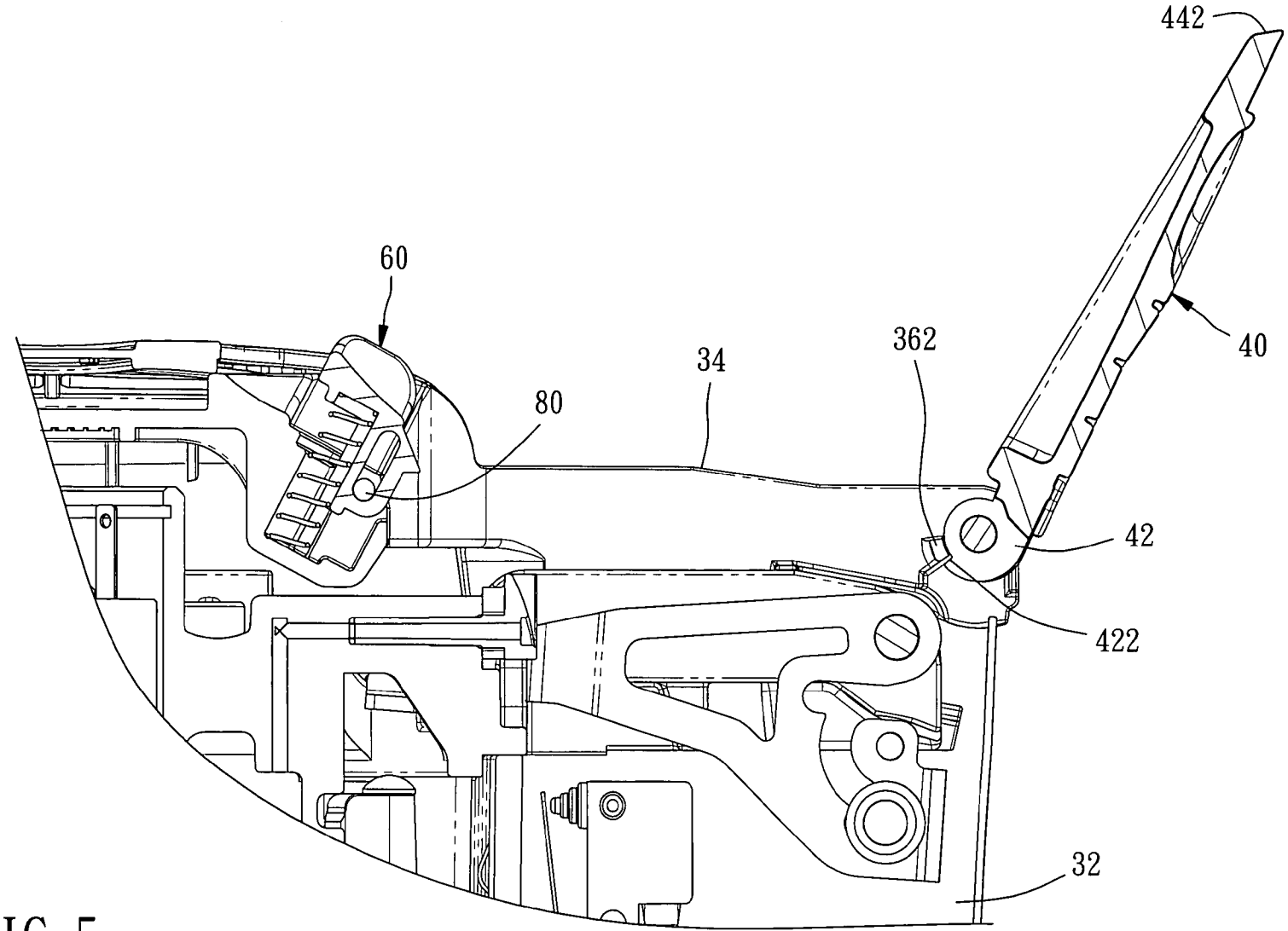
FIG. 5 corresponds to FIG. 4, showing the second stop block released from the first stop block and the cover opened.

Referring to FIG. 3 and FIG. 2 again, the cover 40 has a second coupling structure 42 disposed at its rear side, and a first stop block 44 disposed at its front side The second coupling structure 42 comprises two axle housings 422. Further, a pivot bolt 64 is fastened to the axle housings 422 of the second coupling structure 42 and the axle housings 361 of the first coupling structure 36 to pivotally connect the cover 40 to the holder frame 30, allowing the cover 40 to be turned relative to the holder frame 30 between a close position to close the opening 34 and an open position to open the opening 34. Further, a torsional spring 48 is sleeved onto the pivot bolt 64 between one axle housing 422 of the second coupling structure 42 and one axle housing 361 of the first coupling structure 36 to impart a biasing force to the cover 40, forcing the cover 40 toward the open position. The second coupling structure 42 further comprises two smoothly arched sliding grooves 422 respectively coupled to the protruding blocks 362 to limit the biasing angle of the cover 40 relative to the holder frame 30 (see FIG. 5). Further, the first stop block 44 has a first beveled edge 442.

The control switch 50 is mounted in the receiving hole 38 of the holder frame 30, comprising a button 60, a spring member 70, and a positioning pin 80. The button 60 comprises a cap 62 and a body 64. The body 64 is received in the oblique guide groove 39 of the holder frame 30, comprising a second stop block 642, an oblong slot 644 for the passing of the pin 80, and a recessed hole 646 for holding the spring member 70. The spring member 70 imparts an upward pressure to the button 60, holding the button 60 in a first position P1 shown in FIG. 3.

Figure 4:
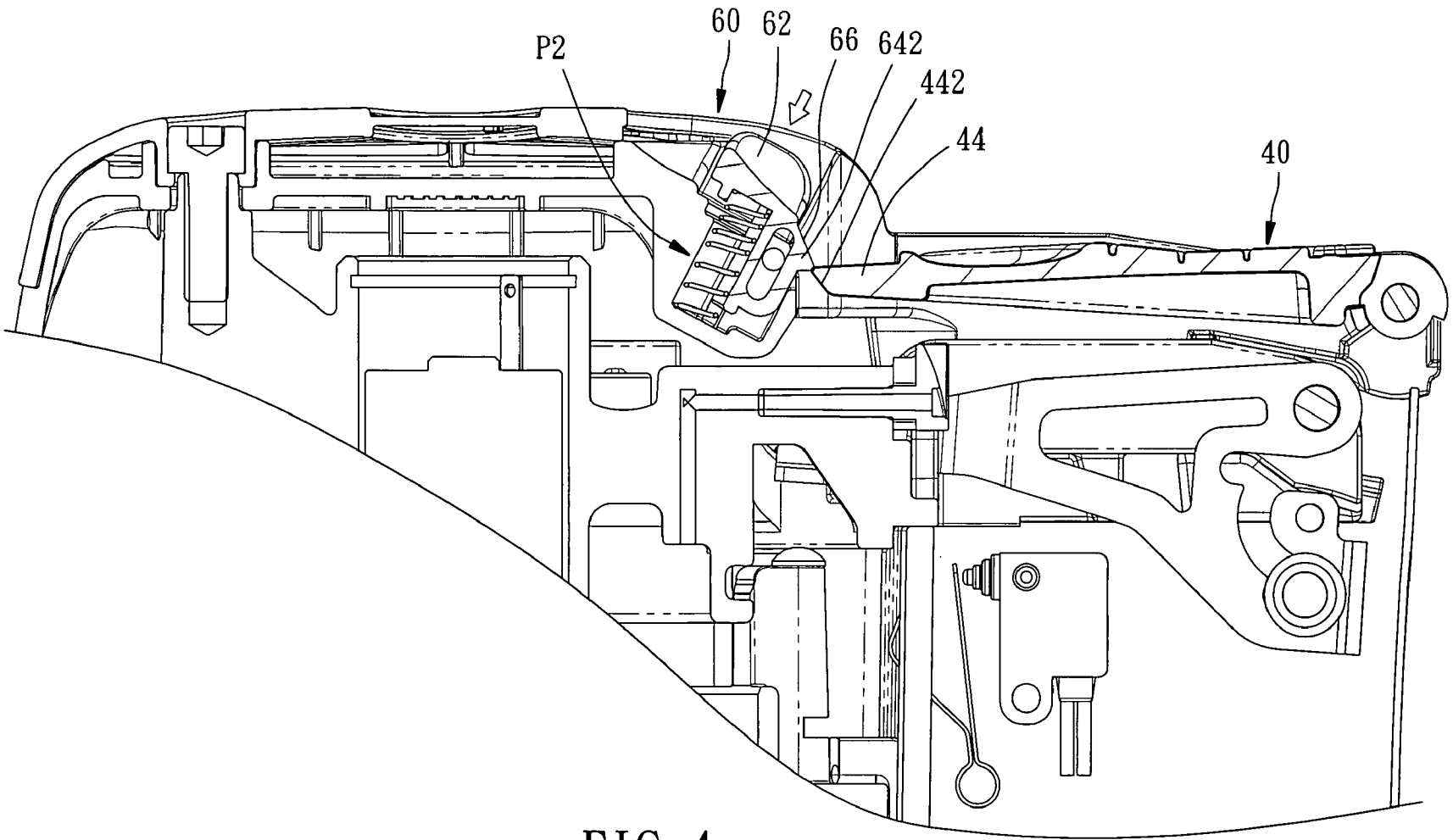
FIG. 4 corresponds to FIG. 3, showing the second stop block lowered with the button relative to the first stop block of the cover.

When the button 60 is not pressed, it is kept in the first position P1, at this time the second stop block 642 is stopped at the top side of the first stop block 44 of the cover 40, holding the cover 40 in the close position. When pressed the button 60, the button 60 is moved downwards along the oblique guide groove 39 to a second position P2 shown in FIG. 4, the second stop block 642 is released from the first stop block 44 of the cover 40, and therefore the cover 40 is forced by the torsional spring 48 to bias from the close position shown in FIG. 3 to the open position shown in FIG. 5, allowing loading of a gas can in the accommodation chamber 32 of the holder frame 30. When the cover 40 is being opened, the spring member 70 pushes the button 60 from the second position P2 back to the first position P1, and the positioning pin 80 prevents the button 60 from falling out of the receiving hole 38 of the holder frame 30. The aforesaid second position P2 is the critical point where the front end of the second stop block 642 is stopped at the front end of the first stop block 44.

Figure 6:
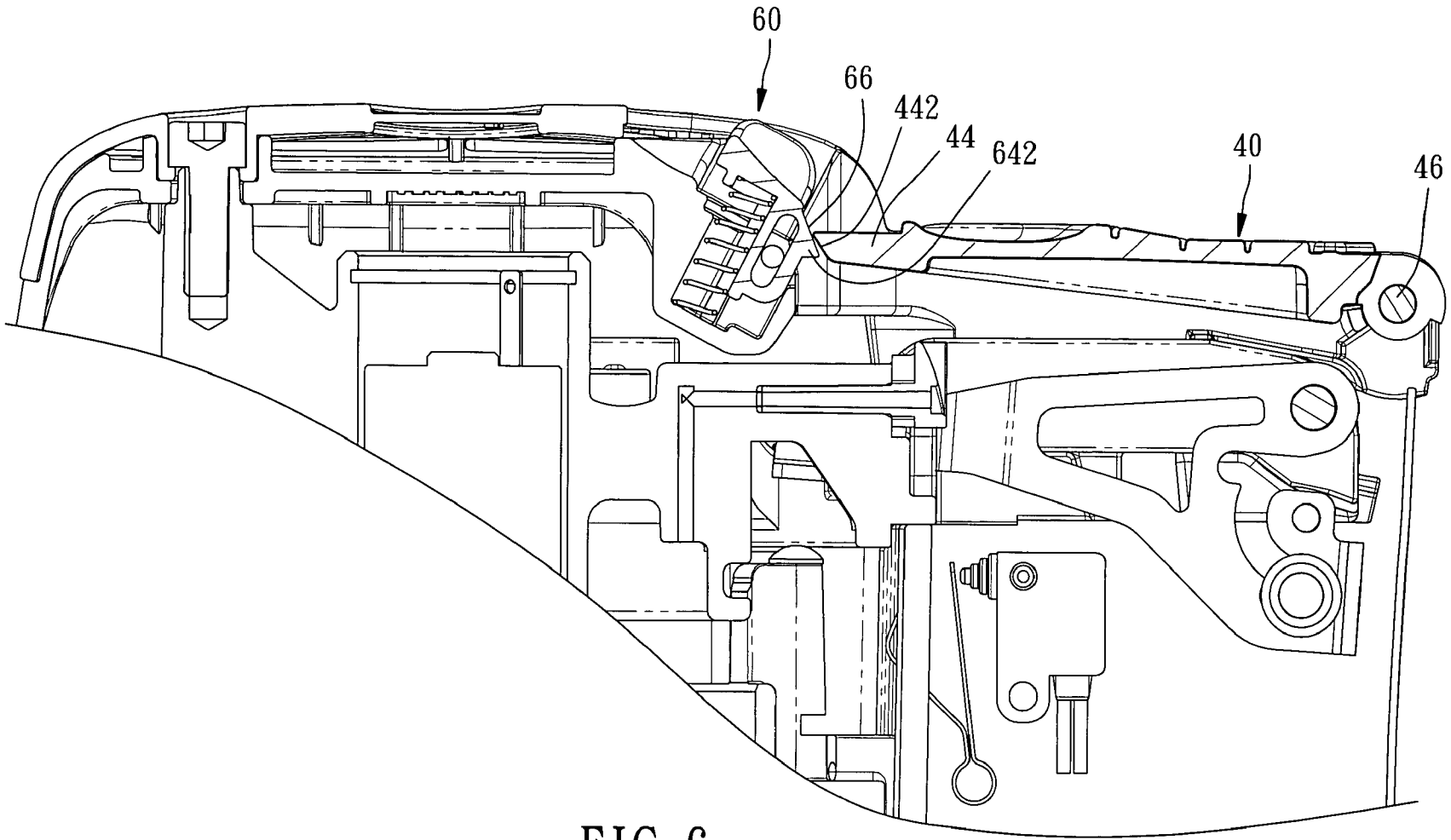
FIG. 6 is another sectional view of the present invention, showing the second beveled edge of the second stop block of the button abutted against the first beveled edge of the first stop block of the cover.

After loading of a gas can, bias the cover 40 from the open position toward the close position to close the opening 34, When biasing of the cover 40 from the open position toward the close position, the first beveled edge 442 of the first stop block 44 will be forced to touch the second beveled edge 66 of the second stop block 642. Continuously biasing the cover 40 toward the close position causes the button 60 to be moved toward the second position P2, as shown in FIG. 6. When the front side of the first stop block 44 of the cover 40 passed over the second position P2, the spring member 70 immediately pushes the button 60 upwardly back to the first position P1 to have the second stop block 642 be stopped at the top side of the first stop block 44, overcoming the biasing force of the torsional spring 48 and holding the cover 40 in the close position As stated above, the invention uses a movable control switch to control the biasing of a cover, enabling the cover to be alternatively held in a close position to close the opening of a gas can accommodation chamber or an open position to open the opening of the gas can accommodation chamber. The design of the present invention facilitates installation of a gas can. Further, moving the parts of the gas can mounting structure do not cause them to wear, lowering the risk of structural damage and saving maintenance cost.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A gas can mounting structure used in a gas-operated nail gun, comprising:

a holder frame, said holder frame comprising an accommodation chamber adapted for accommodating a gas can, an opening disposed in communication with said accommodation chamber and the outside of said holder frame, and an oblique guide groove;

a cover pivoted to said holder frame and biased relative to said holder frame between a close position where said cover closes said opening of said holder frame and an open position where said cover is kept away from said opening, said cover comprising a first stop block; and a control switch, said control switch comprising a button, said button comprising a body and a second stop block protruded from said body, said body being received in said oblique guide groove of said holder frame and movable along said oblique guide groove between a first position where said second stop block is stopped at said first stop block of said cover to hold said cover in said close position and a second position where said second stop block is released from said first stop block for allowing said cover to be biased from said close position to said open position, wherein said cover comprises a coupling structure pivoted to said holder frame, and a torsional spring connected between the coupling structure of said cover and said holder frame to impart a biasing force to said cover relative to said holder frame in direction toward said open position, wherein said holder frame comprises a coupling structure pivotally coupled to the coupling structure of said cover, and two protruding blocks bilaterally protruded from the coupling structure of said holder frame; the coupling structure of said cover comprises two smoothly arched sliding grooves respectively coupled to the protruding blocks of said holder frame to guide movement of said cover relative to said holder frame between said close position and said open position.

2. The gas can mounting structure as claimed in claim 1, wherein said first stop block of said cover comprises a first beveled edge; said second stop block of said button comprises a second beveled edge fitting the first beveled edge of said first stop block of said cover.

3. A gas can mounting structure used in a gas-operated nail gun, comprising:

a holder frame, said holder frame comprising an accommodation chamber adapted for accommodating a gas can, an opening disposed in communication with said accommodation chamber and the outside of said holder frame, and an oblique guide groove;

a cover pivoted to said holder frame and biased by a resilient element relative to said holder frame between a close position where said cover closes said opening of said holder frame and an open position where said cover is kept away from said opening, said cover comprising a first stop block; and a control switch, said control switch comprising a button, said button comprising a body and a second stop block protruded from said body, said body being received in said oblique guide groove of said holder frame and movable along said oblique guide groove between a first position where said second stop block is stopped at said first stop block of said cover to hold said cover in said close position and a second position where said second stop block is released from said first stop block for allowing said cover to be biased from said close position to said open position, wherein said holder frame further comprises a receiving hole disposed in communication with said oblique guide groove; said body of said button comprises an oblong slot; said control switch further comprises a spring member mounted in said receiving hole and stopped against said body of said button to impart an upward pressure to said button, and a positioning pin inserted through the oblong slot to secure said button to said holder frame and to limit the sliding range of said button along said oblique guide groove.

4. The gas can mounting structure as claimed in claim 3, wherein said first stop block of said cover comprises a first beveled edge; said second stop block of said button comprises a second beveled edge fitting the first beveled edge of said first stop block of said cover.

* * * * *